US007568951B1

(12) United States Patent
Tseng

(10) Patent No.: US 7,568,951 B1
(45) Date of Patent: Aug. 4, 2009

(54) SOCKET FOR FAIRY LIGHT

(76) Inventor: Wei-Jen Tseng, 5F, No. 10, Lane 23, Tungshan St., Hsinchu City (TW)

( * ) Notice: Subject to any disclaimer, the term of this patent is extended or adjusted under 35 U.S.C. 154(b) by 0 days.

(21) Appl. No.: 12/035,955

(22) Filed: Feb. 22, 2008

(51) Int. Cl.
*H01R 33/09* (2006.01)

(52) U.S. Cl. ..... 439/619; 439/232

(58) Field of Classification Search ..... 439/602, 439/619, 699.1, 699.2, 220, 232, 356
See application file for complete search history.

(56) References Cited

U.S. PATENT DOCUMENTS 5,498,922 A * 3/1996 Chang ..... 313/318.1
6,113,430 A * 9/2000 Wu ..... 439/619
6,514,105 B2 * 2/2003 Lin ..... 439/699.2
7,249,967 B2 * 7/2007 Tseng ..... 439/575
7,347,706 B1 * 3/2008 Wu et al. ..... 439/320
7,422,489 B1 * 9/2008 Tseng ..... 439/699.2

* cited by examiner

*Primary Examiner*—Tho D Ta
*Assistant Examiner*—Travis Chambers
(74) *Attorney, Agent, or Firm*—Kolisch Hartwell, P.C.

(57) ABSTRACT

A socket for a fairy light has a light-emitting diode (LED) recess being formed in an outer end of the socket and a partition and a holder being formed on a bottom of the LED recess. The holder is implemented with multiple arced walls being formed around the partition. Small LEDs, being smaller than conventional LEDs, can therefore be mounted on the partition and protrude out of the socket and the LED recess will not limit a lighting range of the LED, and the fairy light with small LEDs saves manufacturing costs and energy.

8 Claims, 9 Drawing Sheets

SOCKET FOR FAIRY LIGHT

BACKGROUND OF THE INVENTION

1. Field of the Invention

The present invention relates to a socket, especially to a socket for a fairy light that has a light-emitting diode (LED) being mounted in the socket.

2. Description of the Prior Arts

A fairy light has a light source and a lens and is generally connected in series to form a fairy light assembly. The conventional light source of the fairy light is an incandescent bulb. The lens covers the incandescent bulb and may be colored for aesthetic effects. Light-emitting diodes (LEDs) have advantages over incandescent bulbs including improved electrical efficiency and being more reliable than the incandescent bulb and are replacing incandescent bulbs in many applications. However, with progressing manufacturing skills, LED sizes are getting smaller. A new, small LED has the same brightness as a conventional, big LED and saves manufacturing costs and energy but is smaller than the conventional LED.

With reference to FIGS. 8 and 9, a conventional fairy light (80) has a casing (82), a socket (83) and an LED (81A, 81B). The casing (82) is tubular and has a distal end and a light mount. The light mount is formed in the distal end of the casing (82). The socket (83) corresponds to and is mounted in the light mount of the casing (82) and has an outer end and an LED recess (831). The LED recess (831) is formed in the outer end of the socket (83). The LED (81A, 81B) is mounted in the LED recess (831) of the socket (83). The LED (81A, 81B) may 24 be a small LED (81B) being fully mounted in the recess (831), or a conventional LED (81A) protruding from the recess (831).

Although the small LED (81B) may be mounted in the LED recess (831) of the socket (83), the LED recess (831) was originally designed for the conventional LED (81A). Therefore, the LED recess (831) may limit lighting range of the small LED (811B). However, since many pre-existing technologies are designed around conventional LEDs (81A) and these technologies have manufacturing plants and tools equipped for their production, have passed various safety inspections and have attained safety standards, appearance and sizes of the socket (83) are very expensive to redesign for small LEDs (81B).

To overcome the shortcomings, the present invention provides a socket for a fairy to mitigate or obviate the aforementioned problems.

SUMMARY OF THE INVENTION

The main objective of the present invention is to provide a socket for a fairy light that reduces manufacturing costs and energy usage. The socket in accordance with the present invention has a light-emitting diode (LED) recess being formed in an outer end of the socket and a partition and a holder being formed on a bottom of the LED recess. The holder is implemented with multiple arced walls being formed around the partition. A small LED being smaller than conventional LEDs can be mounted on the partition and protrude out of the socket. Therefore, the LED recess will not limit a lighting range of the LED, and the fairy light with small LEDs saves manufacturing costs and energy.

DETAILED DESCRIPTION OF THE PREFERRED EMBODIMENTS

Figure 3:
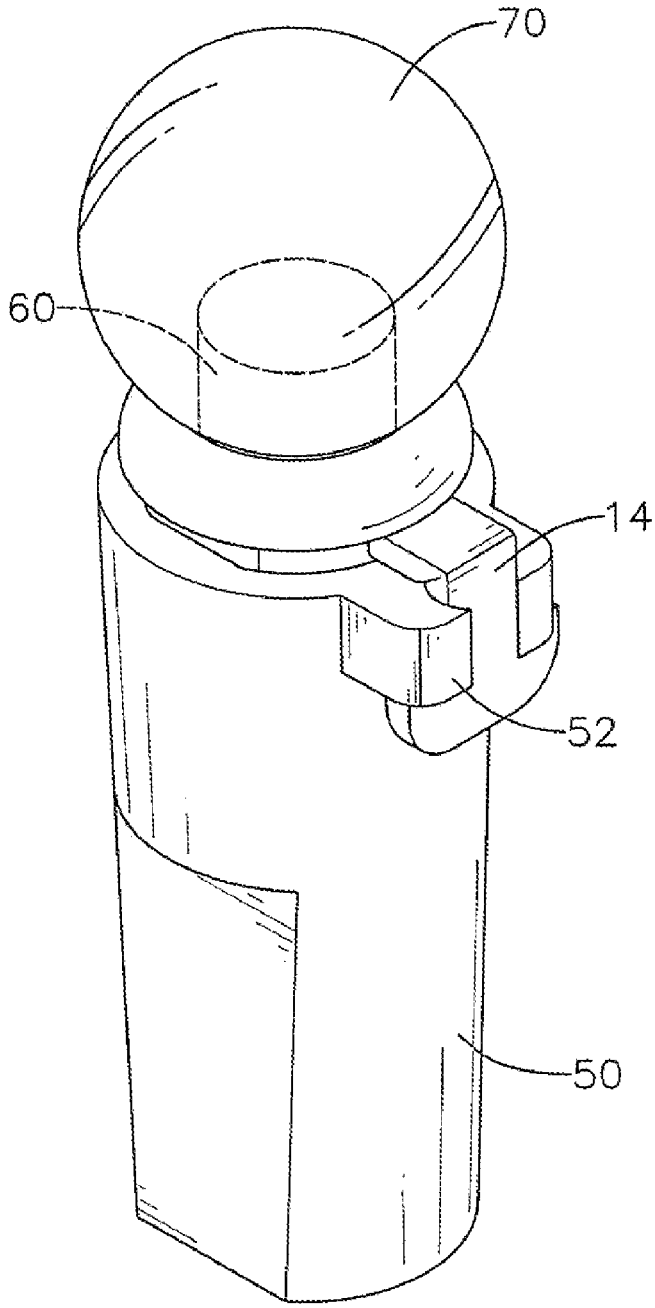
FIG. 3 is an operational perspective view of the socket in FIG. 1, shown with a light-emitting diode (LED) mounted therein and shown in phantom lines and the socket being mounted in a casing having a lens.
Figure 4:
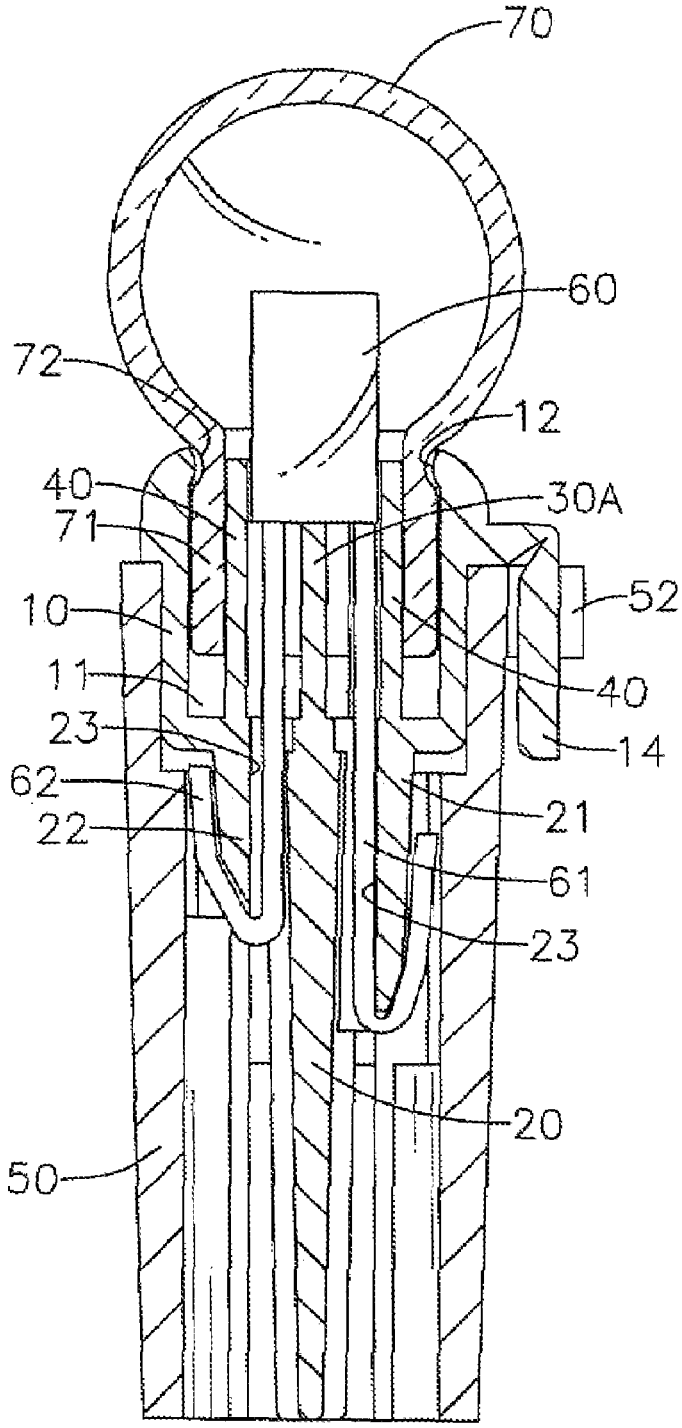
FIG. 4 is an operational side view in partial section of the socket in FIG. 3.
Figure 7:
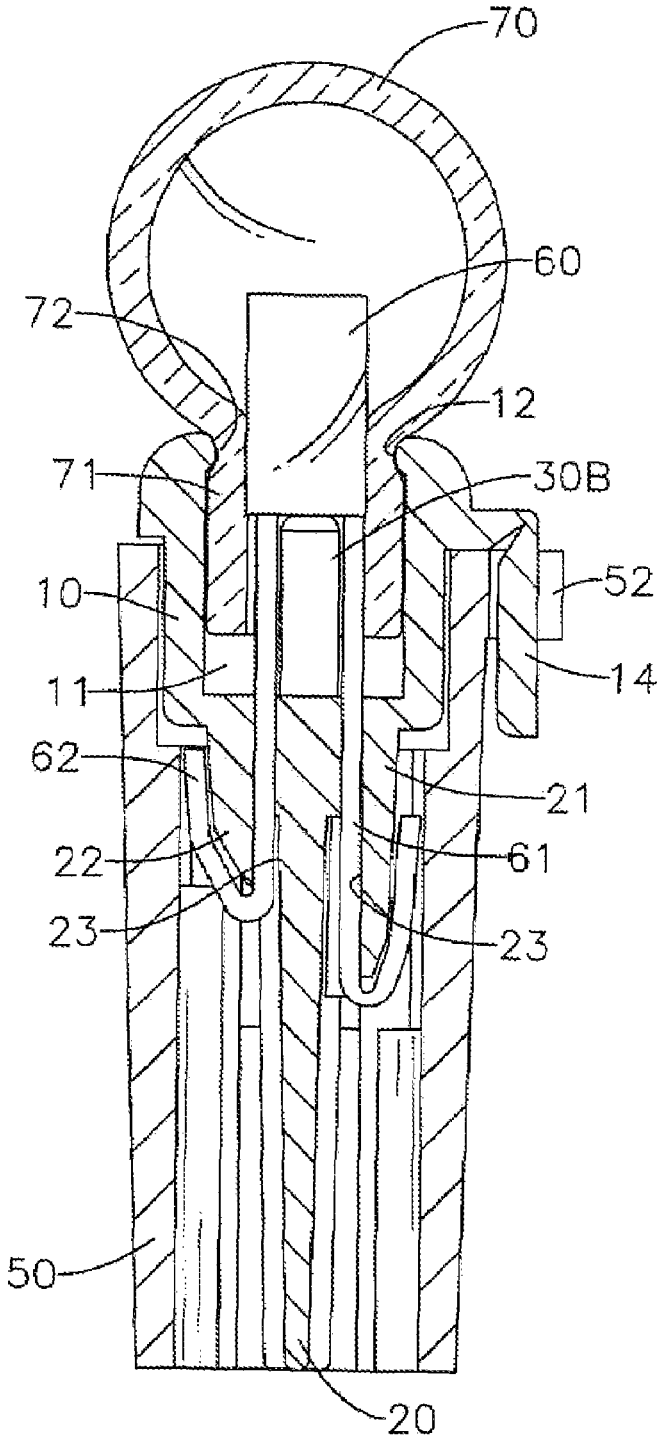
FIG. 7 is an operational cross-sectional side view of the socket in FIG. 5, shown with an LED mounted therein and shown in phantom lines and the socket being mounted in a casing having a lens.
Figure 8:
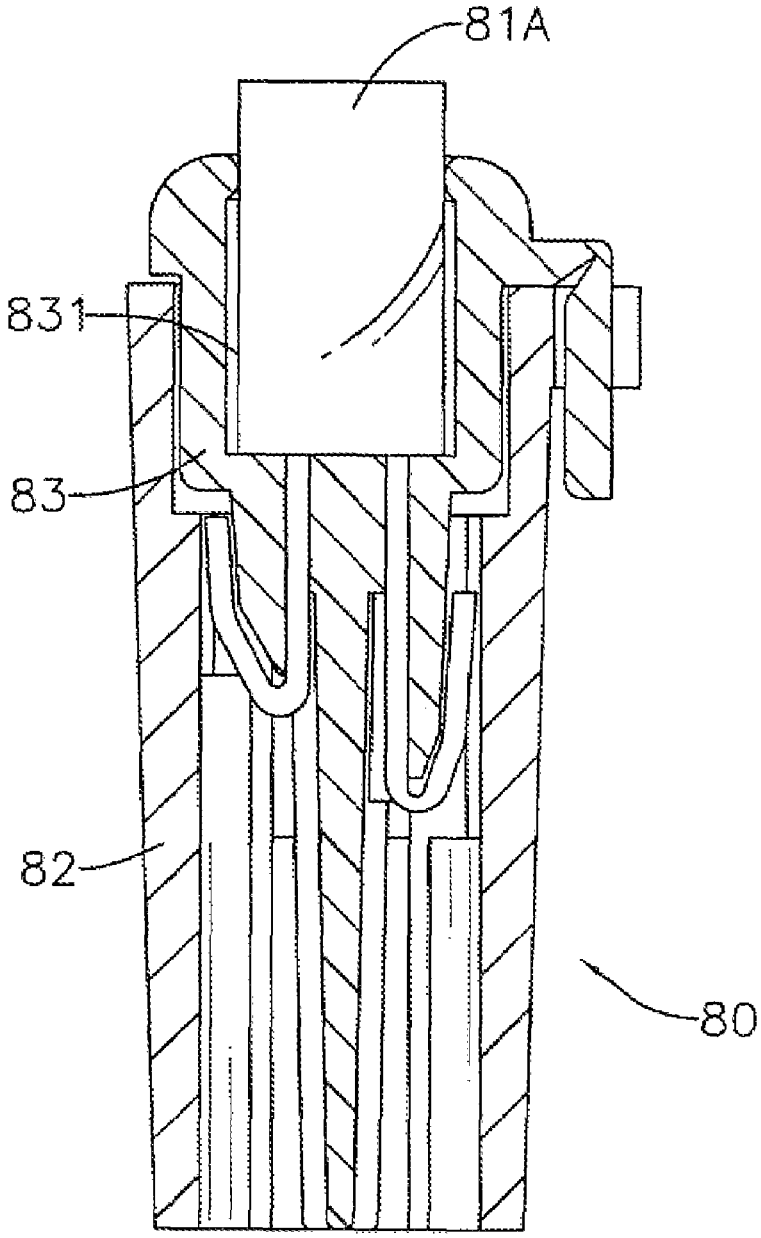
FIG. 8 PRIOR ART
FIG. 8 is an operational side view in partial section of a socket for a fairy light in accordance with the prior art shown with a conventional LED being mounted in the socket.
Figure 9:
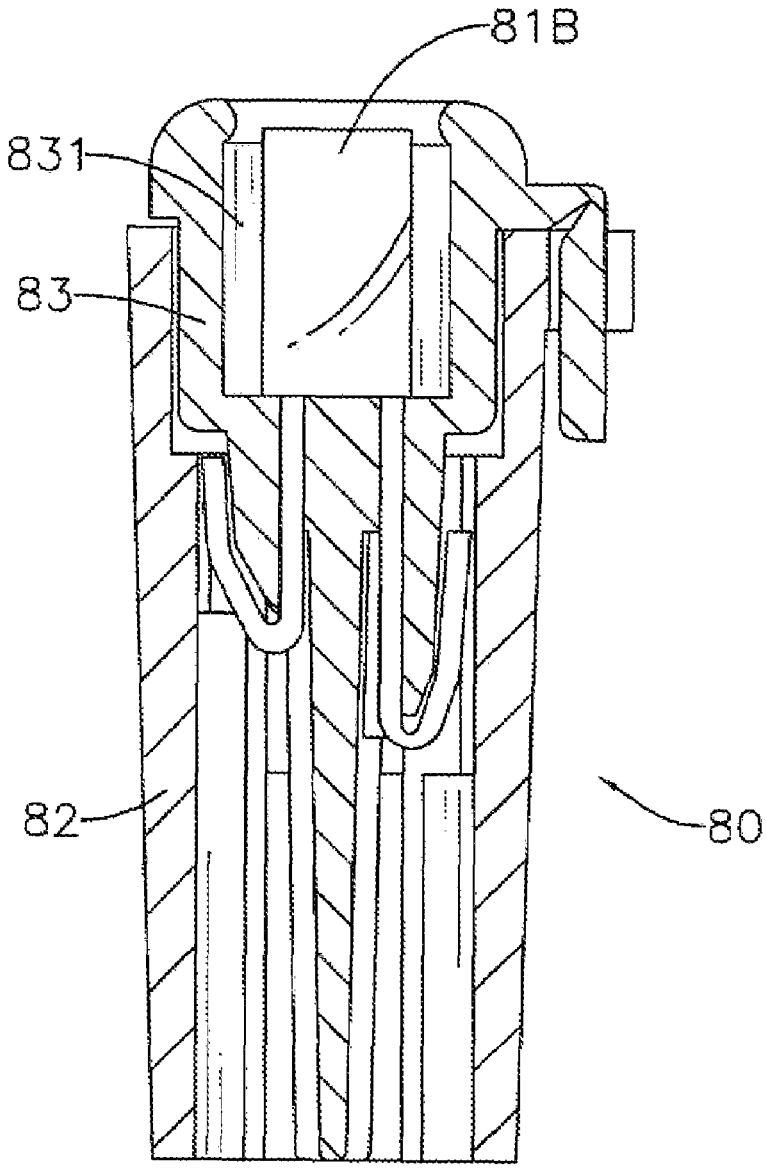
FIG. 9 PRIOR ART
FIG. 9 is an operational side view in partial section of the socket in FIG. 7 shown with a small LED being mounted in the socket.

With reference to FIGS. 3, 4 and 7, a fairy light comprises a casing (50), a light-emitting diode (LED) (60) and a lens (70). The casing (50) is tubular and has a distal end, an outer surface, a light mount and a latch (52). The light mount is formed in the distal end of the casing (50) and may be keyed. The latch (52) is formed on the outer surface of the casing (50) adjacent to the light mount. The LED (60) has two terminals (61, 62). The terminals (61, 62) may comprise a first terminal (61) and a second terminal (62). The lens (70) has a mounting tube (71) and an annular recess (72). The mounting tube (71) protrudes from and communicates with the lens (70) and has and outer surface and a proximal end. The annular recess (72) is formed around the outer surface of the mounting tube (771) adjacent to the proximal end.

Figure 1:
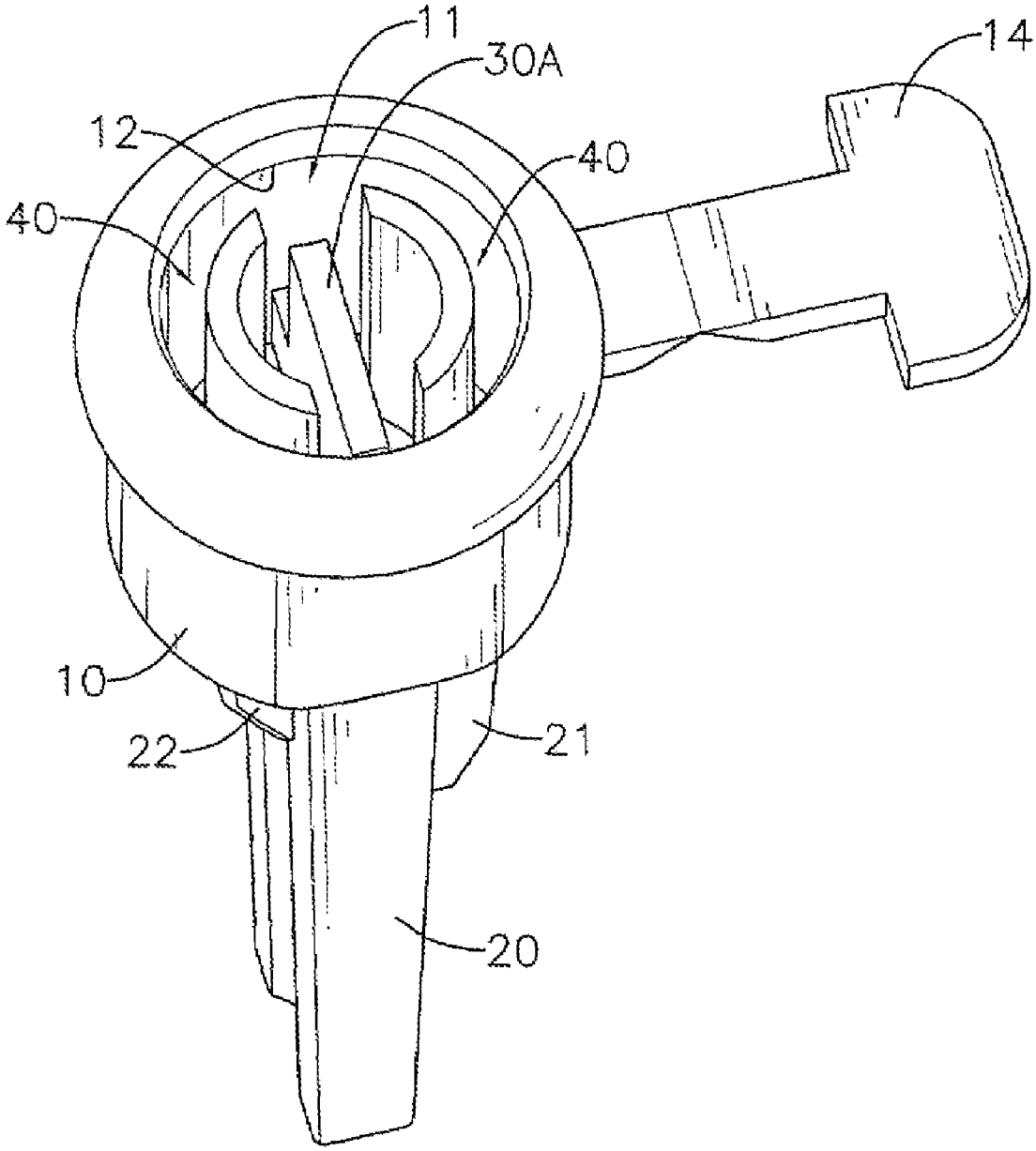
FIG. 1 is a perspective view of a first embodiment of a socket for a fairy light in accordance with the present invention.
Figure 5:
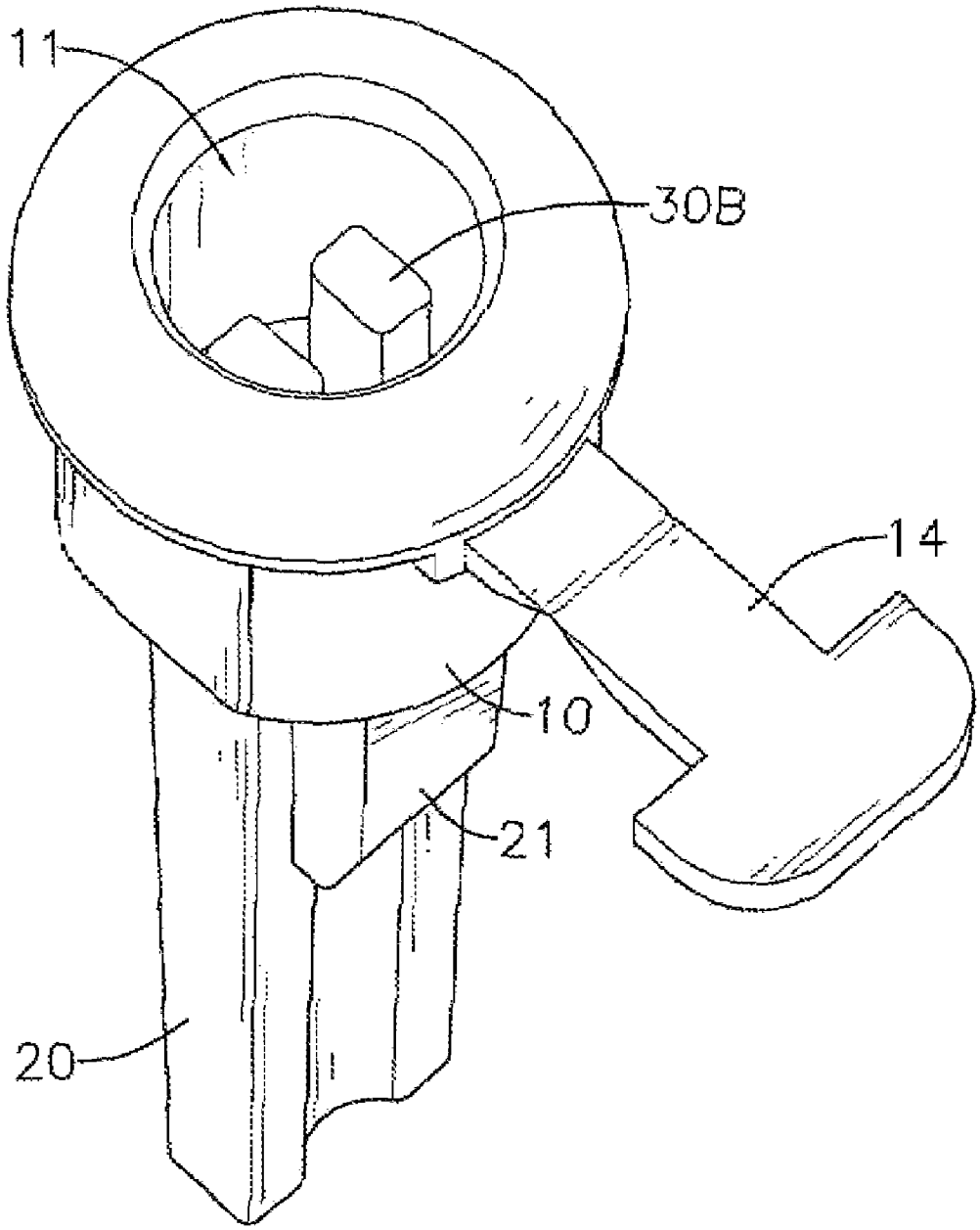
FIG. 5 is a perspective view of a second embodiment of a socket for a fairy light in accordance with the present invention.

With further reference to FIGS. 1 and 5, a socket for a fairy light in accordance with the present invention corresponds to and is mounted in the light mount of the casing (50) and comprises an LED seat (10), a terminal mount (20), a partition (30A, 30B) and a holder (40).

The LED seat (10) may be keyed to hold the socket securely in the casing (50) and prevent rotation and has an outer end, a bottom, an outer wall and an LED recess (11) and may have an annular protrusion (12) and a latch bar (14).

The LED recess (11) is formed in the outer end of the LED seat (10) and has a top edge and a bottom.

With further reference to FIGS. 4 and 7, the annular protrusion (12) is formed around the top edge of the LED recess (11) and engages the annular recess (72) of the lens (70) to hold the mounting tube (71) of the lens (70) securely in the LED seat (10).

The latch bar (14) is bendable, is formed on the outer wall of the LED seat (10) near the outer end and corresponds to and selectively engages the latch (52) of the casing (50) to ensure the socket is held securely in the casing (50).

Figure 2:
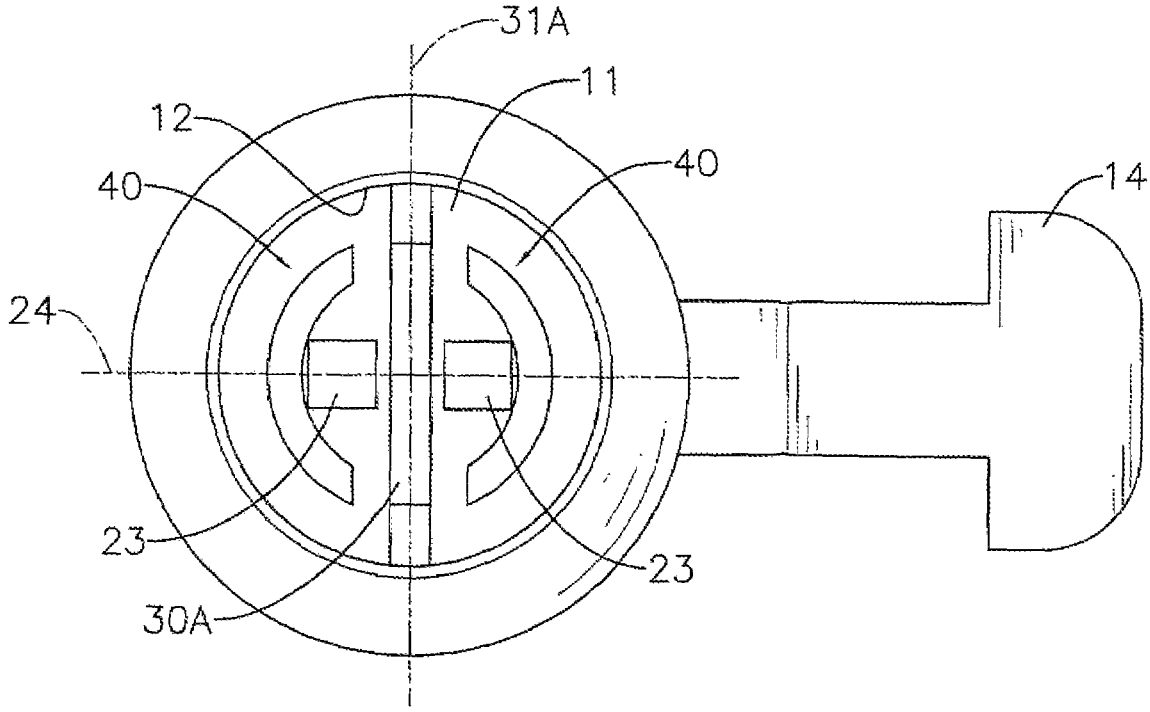
FIG. 2 is a top view of the socket in FIG. 1.
Figure 6:
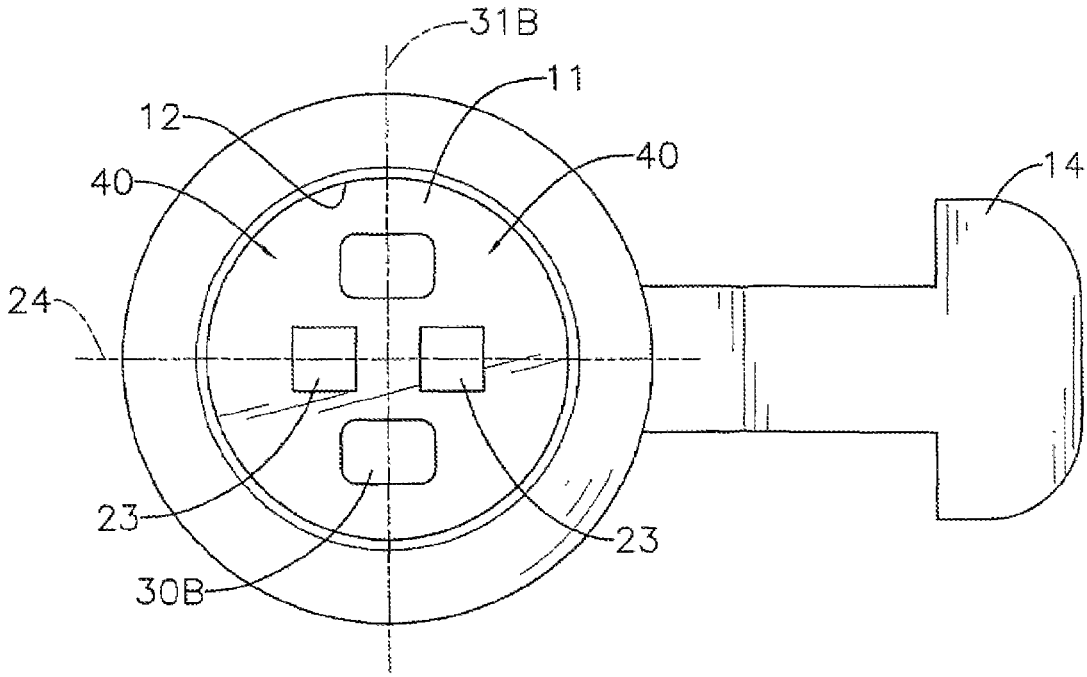
FIG. 6 is a top view of the socket in FIG. 5.

With further reference to FIGS. 2 and 6, the terminal mount (20) is formed on and protrudes from the bottom of the LED seat (10) and has two opposite surfaces, two terminal protrusions (21, 22), two through holes (23) and a first axis (24).

The terminal protrusions (21, 22) are formed respectively on the surfaces of the terminal mount (20) adjacent to the bottom of the LED seat (10) and may comprise a first terminal protrusion (21) and a second terminal protrusion (22).

The through holes (23) are formed respectively through the terminal mount (20) and between the terminal protrusions (21, 22) and communicate with the LED recess (11) of the LED seat (10).

The first axis (24) is extended through the through holes (23) of the terminal mount (20).

The partition (30A, 30B) is formed on and protrudes from the bottom of the LED recess (11) of the LED seat (10) and between the through holes (23) of the terminal mount (20), has a second axis (31A, 31B) and may comprise a wall (30A) or multiple posts (30B).

The second axis (31A, 31B) is extended through the partition (30A, 30B). The second axis (31A) may be extended through the wall (30A) and may be perpendicular to the first axis (24) of the terminal mount (20). The second axis (31B) may be extended through the posts (30B) and may be perpendicular to the first axis (24) of the terminal mount (20).

The holder (40) is formed on the bottom of the LED recess (11) of the LED seat (10) and around the partition (30A) and the through holes (23) and is implemented with multiple arced walls.

The socket for the fairy light as described has the following advantages. The terminals (61, 62) of the LED (60) are mounted respectively through the through holes (23) of the terminal mount (20) and are bent to allow the first terminal (61) to abut the first terminal protrusion (21) and the second terminal (62) to abut the second terminal protrusion (22). The LED (60) can be mounted on the partition (30A, 30B) and protrude out of the outer end of the LED seat (10). Therefore, a lighting range of the LED (50) will not be limited by the LED recess (11).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A socket for a fairy light comprising a light-emitting diode (LED) seat having an outer end;

a bottom;

an outer wall; and an LED recess being formed in the outer end of the LED seat and having a top edge; and a bottom;

a terminal mount being formed on and protruding from the bottom of the LED seat and having two opposite surfaces;

two terminal protrusions being formed respectively on the surfaces of the terminal mount adjacent to the bottom of the LED seat;

two through holes being formed respectively through the terminal mount and between the terminal protrusions and communicating with the LED recess of the LED seat; and a first axis being extended through the through holes of the terminal mount;

a partition being formed on and protruding from the bottom of the LED recess of the LED seat and between the through holes of the terminal mount and having a second axis being extended through the partition; and a holder being formed on the bottom of the LED recess of the LED seat and around the partition and the through holes and being implemented with multiple arced walls.

2. The socket as claimed in claim 1, wherein the LED seat is keyed and has a latch bar being bendable and being formed on the outer wall of the LED seat near the outer end.

3. The socket as claimed in claim 1, wherein the LED seat further has an annular protrusion being formed around the top edge of the LED recess.

4. The socket as claimed in claim 1, wherein the terminal protrusions of the terminal mount comprise a first terminal protrusion and a second terminal protrusion.

5. The socket as claimed in claim 1, wherein the partition comprises a wall.

6. The socket as claimed in claim 5, wherein the second axis is extended through the wall and is perpendicular to the first axis of the terminal mount.

7. The socket as claimed in claim 1, wherein the partition comprises multiple posts.

8. The socket as claimed in claim 7, wherein the second axis is extended through the posts and is perpendicular to the first axis of the terminal mount.

* * * * *